US005924136A

United States Patent [19]

Ogean

[11] Patent Number: 5,924,136

[45] Date of Patent: Jul. 20, 1999

[54] HAND MOUNTED POCKET

[76] Inventor: Bruce E. Ogean, 7160 S. Harding Ave., Chicago, Ill. 60629

[21] Appl. No.: 08/938,691

[22] Filed: Sep. 26, 1997

[51] Int. Cl.[6] ..... A41D 19/00; A45F 5/00

[52] U.S. Cl. ..... 2/159; 2/160; 2/163; 2/170; 2/917; 224/219

[58] Field of Search ..... 2/158, 159, 160, 2/162, 163, 170, 247, 917; 150/154; 224/101, 164, 165, 191, 217, 218, 219, 222, 267

[56] References Cited

U.S. PATENT DOCUMENTS

| | | |
|---|---|---|
| 137,988 | 4/1873 | Whipple . |
| 214,823 | 4/1879 | Hopkins . |
| 275,780 | 4/1883 | Mahar . |
| 334,884 | 1/1886 | Moore . |
| D. 357,641 | 4/1995 | Grodin . |
| 471,000 | 3/1892 | Green . |
| 601,982 | 4/1898 | Peirson . |
| 706,997 | 8/1902 | Ogborn . |
| 1,129,492 | 2/1915 | Hyslin . |
| 1,504,836 | 11/1924 | Rehn . |
| 1,613,664 | 1/1927 | Lewandowski . |
| 1,628,278 | 5/1927 | Scheuer . |
| 1,719,641 | 7/1929 | Abrahamson . |
| 1,966,822 | 7/1934 | Lieb . |
| 1,970,081 | 8/1934 | Eisendrath . |
| 1,982,431 | 11/1934 | Hines . |
| 2,403,507 | 7/1946 | Davio . |
| 2,423,448 | 7/1947 | Haight . |
| 3,189,073 | 6/1965 | Todd . |
| 3,421,160 | 1/1969 | Domenico . |
| 3,627,182 | 12/1971 | Calkins . |
| 3,670,933 | 6/1972 | Jones . |
| 3,924,304 | 12/1975 | Grandmont . |
| 4,034,979 | 7/1977 | Wester . |
| 4,121,360 | 10/1978 | Vlerebome . |
| 4,247,097 | 1/1981 | Schwartz . |
| 4,326,706 | 4/1982 | Guthrie et al. . |
| 4,330,120 | 5/1982 | Netti . |
| 4,462,116 | 7/1984 | Sanzone et al. . |
| 4,531,241 | 7/1985 | Berger . |
| 4,670,909 | 6/1987 | Forrester . |
| 4,684,123 | 8/1987 | Fabry . |
| 4,757,558 | 7/1988 | Strongwater . |
| 4,761,835 | 8/1988 | Chen . |
| 4,766,611 | 8/1988 | Kim . |
| 4,785,478 | 11/1988 | Mosley . |
| 4,805,242 | 2/1989 | Bolton . |
| 4,809,366 | 3/1989 | Pratt . |
| 4,850,341 | 7/1989 | Fabry et al. . |
| 4,856,149 | 8/1989 | Brame . |
| 4,862,521 | 9/1989 | Mann . |
| 4,933,992 | 6/1990 | Kallman . |
| 5,003,637 | 4/1991 | Lonon . |
| 5,004,227 | 4/1991 | Hoffman . |
| 5,088,121 | 2/1992 | Wallace . |
| 5,276,922 | 1/1994 | Floyd, Jr. . |
| 5,300,000 | 4/1994 | Schwartz . |
| 5,386,710 | 2/1995 | Moore . |
| 5,466,215 | 11/1995 | Lair et al. . |
| 5,472,125 | 12/1995 | Barnard . |
| 5,577,273 | 11/1996 | Newkirk et al. . |
| 5,607,090 | 3/1997 | Brown . |
| 5,623,731 | 4/1997 | Ehrgott et al. . |
| 5,779,113 | 7/1998 | Huang . |

*Primary Examiner*—John J. Calvert
*Assistant Examiner*—Shirra L. Jenkins
*Attorney, Agent, or Firm*—Robert Toczycki

[57] ABSTRACT

A hand mounted pocket for placement on a back of a hand. The hand mounted pocket comprises: a wrist band, at least one finger band, and a pocket panel. The wrist band is annular and is sized to engage a person's wrist. The at least one finger band is annular and is sized to engage at least one finger of a person's hand. The wrist band and the at least one finger band are joined by the pocket panel, wherein an upper portion of the pocket panel is attached to the at least one finger band, and a lower portion of the pocket panel is attached to the wrist band. The pocket panel is sized to extend across a back portion of a hand, the pocket panel has at least one pocket therein.

19 Claims, 6 Drawing Sheets

HAND MOUNTED POCKET

BACKGROUND OF THE INVENTION

1. Field of the Invention

The present invention relates generally to a new type of wallet or pocket that is convenient for a person to wear. More specifically the present invention provides a flexible hand mounted pocket that allows users to store objects on the back of the hand, and retrieve them easily. This type of hand mounted pocket can be conveniently used when availability of pockets is limited, especially when going to the beach, taking part in any type of athletic activity, attending picnics, amusement parks, etc. The hand mounted pocket can store a variety of small items including money, credit cards, identification, keys, jewelry, make-up or any other small devices.

2. Description of the Prior Art

The prior art discloses various different types of gloves with pockets and hand devices. The gloves disclosed in the prior art disclose winter-type gloves having full fingered gloves that provide a pocket for storage, as can be seen in U.S. Pat. No. 4,862,521 issued to Mann and U.S. Pat. No. 4,670,909 issued to Forrester, however, this type of device is not practical for use when it is warm outdoors. Other types of devices feature: a sun blocking glove as disclosed in U.S. Pat. No. 4,785,478 issued to Mosley; a hand carried traffic signal as shown in U.S. Pat. No. 1,966,822 issued to Lieb; and an identification bracelet as illustrated in U.S. Pat. No. 4,121,360 issued to Vlerebome. However, none of these devices are intended to have pockets and to offer the inventive features of the present invention.

It is therefore an object of the present invention to provide a hand mounted pocket that can be worn outdoors during warm weather, whereby the hand mounted pocket will allow a user's hand to remain cool while it is being worn. It is further contemplated that the present invention be fashionable as well as practical for a person to use, especially when the availability of pockets on the person's clothing is limited.

These and other types of gloves and devices used in the past do not offer the flexibility and inventive features of my hand mounted pocket. As will be described in greater detail hereinafter, the hand mounted pocket of the present invention differs from those previously proposed.

SUMMARY OF THE INVENTION

According to my present invention I have provided a hand mounted pocket for placement on a back of a hand. The hand mounted pocket comprises: a wrist band, at least one finger band, and a pocket panel. The wrist band is annular and is sized to engage a person's wrist. The at least one finger band is annular and is sized to engage at least one finger of a person's hand. The wrist band and the at least one finger band are joined by the pocket panel, wherein an upper portion of the pocket panel is attached to the at least one finger band, and a lower portion of the pocket panel is attached to the wrist band. The pocket panel is sized to extend across a back portion of a hand, the pocket panel has at least one pocket therein.

I have further provided a hand mounted pocket as described above, wherein the lower portion of the pocket panel has a width equivalent to a width of a person's wrist, and the upper portion of the pocket panel having a width equivalent to a width of the at least one finger band.

Still another feature of my invention concerns the hand mounted pocket described above, wherein the pocket panel is made from a material selected from the group consisting of: lycra, rubber, cotton and nylon.

Still yet another feature of my invention concerns the hand mounted pocket of as described above, wherein the at least one pocket has an access opening extending along the length of the pocket panel on one side.

Yet another feature of my invention concerns the hand mounted pocket as described above, wherein the at least one pocket has an access opening extending along the width of the lower portion of the pocket panel.

A still further feature of my invention concerns the hand mounted pocket as described above, wherein the at least one pocket comprises a flap that is hinged along the lower portion of the pocket panel, the flap is securable at edges along the upper portion and along opposite edges extending between the wrist band and the at least one finger band.

An even further feature of my invention concerns the hand mounted pocket as described above, wherein the wrist band is comprised of an elastic band.

Yet still another feature of my invention concerns the hand mounted pocket as described above, wherein the wrist band is comprised of a strap having two ends, wherein each of the ends has hook and loop fasteners attached thereto for securing the wrist band to a wrist of a user.

According to other features in invention I have provided a hand mounted pocket as described above, wherein the at least one pocket has an access opening and a hook and loop fastener closure thereon.

Still another feature of my invention concerns the hand mounted pocket as described above, wherein the at least one pocket has an access opening and a zipper closure thereon.

Yet another feature of my invention concerns the hand mounted pocket as described above, wherein the at least one pocket has an access opening and a closure means comprising overlapping flaps of material.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
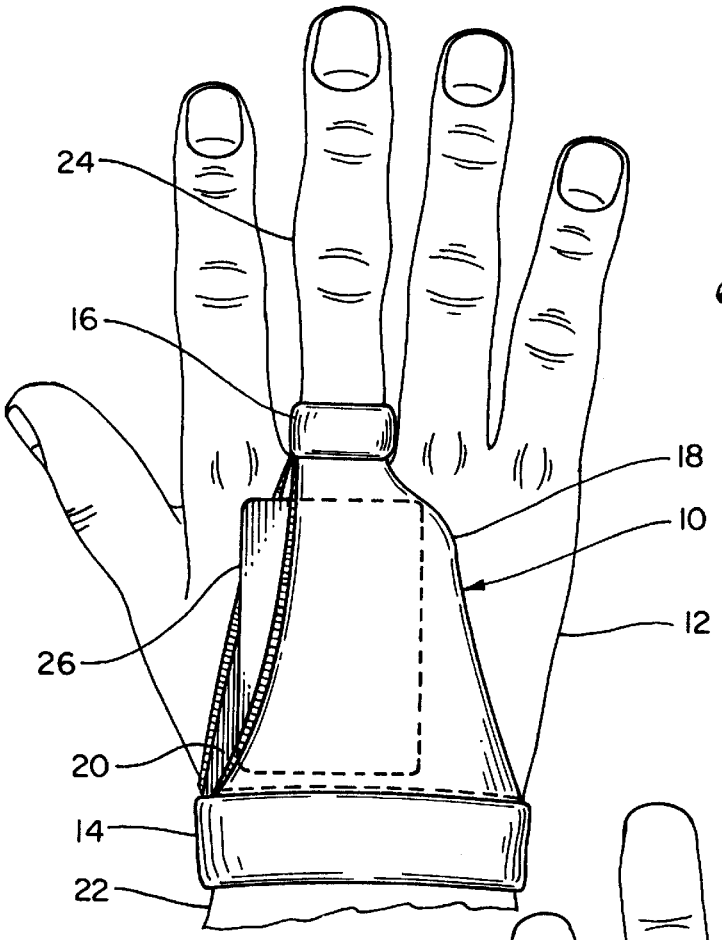
FIG. 1 is a top plan view of one embodiment of my invention as shown on a hand.
Figure 2:
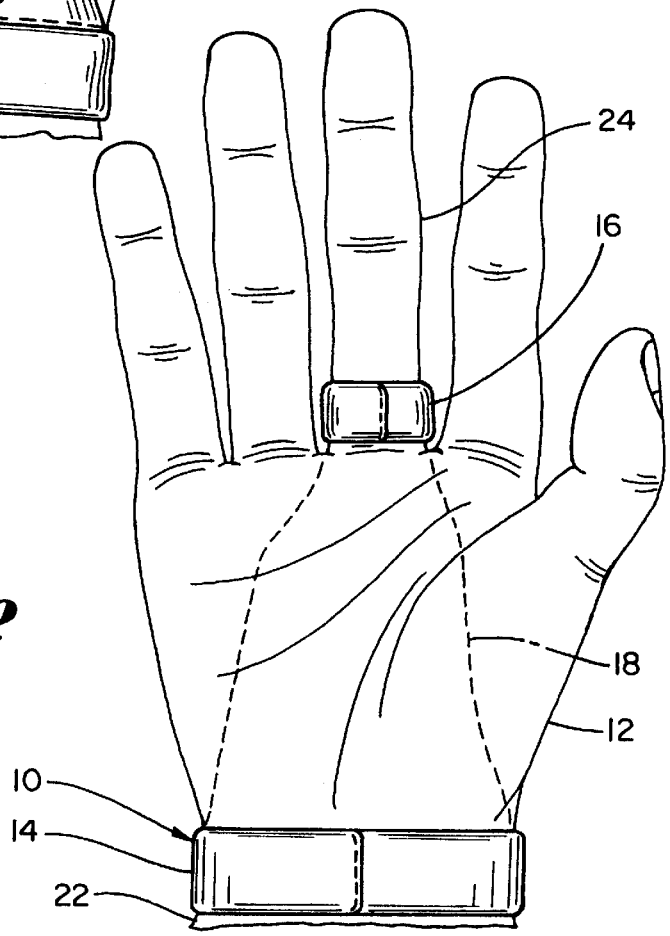
FIG. 2 is a bottom plan view of my hand mounted pocket shown in FIG. 1.

Referring now to the drawings, FIGS. 1 and 2 show one embodiment of my hand mounted pocket 10 attached to a hand 12 of a person. The hand mounted pocket 10 is comprised of a wrist band 14 extending around a person's wrist, a finger band 16 extending around a person's finger, and a pocket panel 18 extending across the back portion of a person's hand. The hand mounted pocket 10 is designed to allow a user to store objects on the back of the hand in a pocket 20. The wrist band 14 is annular and is sized to engage a wrist 22 of a person. The wrist band 14 shown in FIGS. 1 and 2 is an elastic band that can be easily placed over a person's hand 12 and onto the person's wrist 22 and to hold tight to the wrist.

The finger band 16 can also be an elastic band that is annular and is sized to comfortably engage a person's finger 24. The wrist band 14 and the finger band 16 are joined by the pocket panel 18. An upper portion of the pocket panel is attached or sewn to the finger band 16, and a lower portion of the pocket panel 18 is attached or sewn to the wrist band 14. The pocket panel 18 is sized to extend across a back portion of a hand and leaving the palm of the hand exposed. The pocket panel 18 defines the pocket 20. The pocket panel 18 has preferably at least 2 layers of material to form the pocket 20.

The lower portion of my pocket panel 18 is designed to have a width equivalent to a width of a person's wrist in order to allow enough room create an adequately sized pocket. The upper portion of my pocket panel 18 is designed to have a width equivalent to a width of the finger band 16. It is preferable, but not required, to have the pocket opening 20 positioned on the inner portion (thumb side) of the hand, since the pocket opening will typically be naturally positioned upwardly or sideways, and will then help prohibit items from falling out of the pocket.

Excellent results can be obtained when the pocket panel 10 is made of a flexible material such as spandex. This material helps provide a fashionable style, as well as flexibility for the pocket to stretch as the hand 12 is open and closed, furthermore, objects, such as a credit card 26 can be easily placed within the pocket 20 and allowing the pocket to stretch and conform to any object placed into the pocket 20. Other materials that can be used include: rubber, cotton, leather, nylon and any other suitable material that is somewhat flexible and/or fashionable. If inflexible material is used, excellent results can be obtained by pleating the material to allow for expansion of the pocket.

Figure 3:
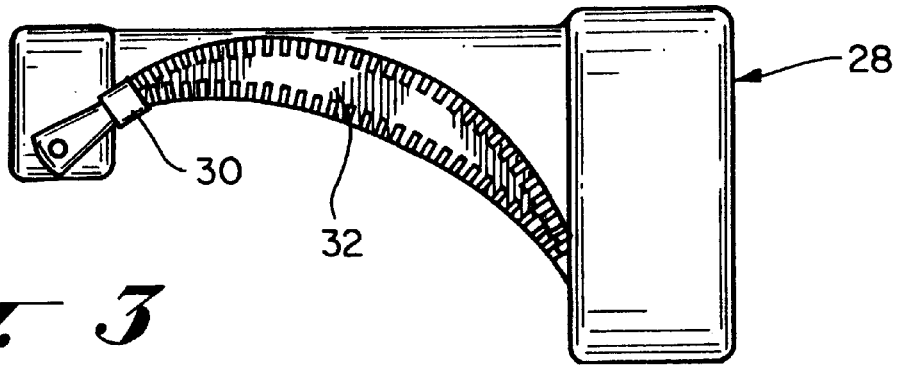
FIG. 3 is a side view of my hand mounted pocket showing how a zipper can be used to open and close the pocket.
Figure 4:
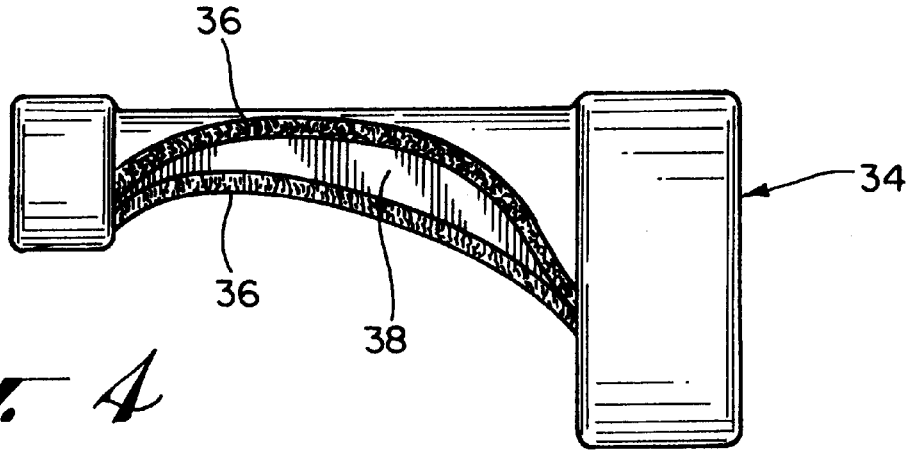
FIG. 4 is a side view of my hand mounted pocket showing how hook and loop fasteners can be used to open and close the pocket.
Figure 5:
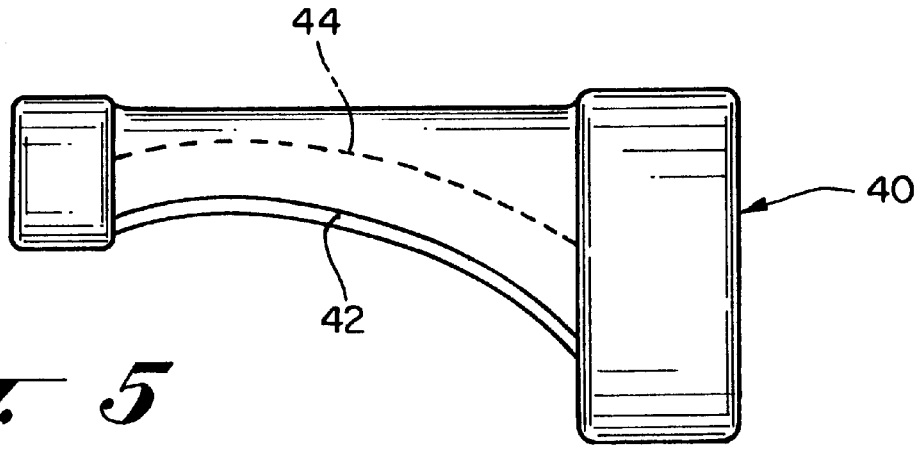
FIG. 5 is a side view of my hand mounted pocket showing how overlapping ends are used to allow access to the pocket.

The pocket of my hand mounted pocket can be accessed and closed a variety of ways. FIG. 3 illustrates one version of my hand mounted pocket 28 using a zipper 30 to open and close the pocket 32 located on the side of the hand mounted pocket. FIG. 4 illustrates another version of my hand mounted pocket 34 using a hook and loop fastener 36 to open and close the pocket 38. FIG. 5 illustrates still another version of my hand mounted pocket 40 using overlapping flaps of material wherein an upper piece of material 42 overlaps a middle piece of material 44 and thereby covers access to a pocket within the hand mounted pocket 40.

Figure 6:
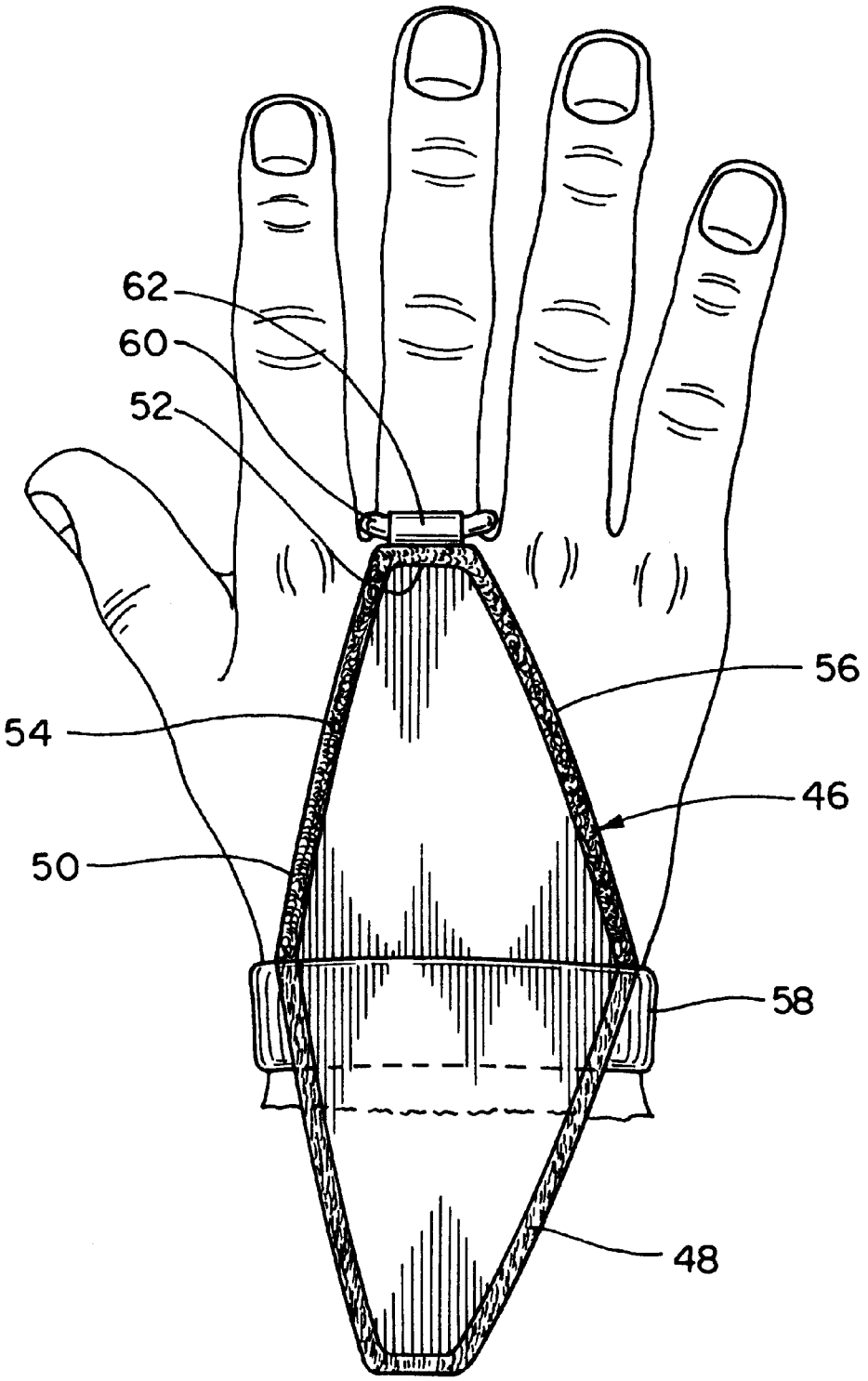
FIG. 6 is a top plan view of another embodiment of my invention as shown on a hand.

Another variation of my hand mounted pocket is shown in FIG. 6. The pocket of the hand mounted pocket 46 is basically a flap 48 that is hinged along the lower portion of the pocket panel 50. The flap is securable at edges along the upper portion 52 and along opposite edges 54, 56 extending between the wrist band 58 and the finger band 60. Another type of finger band 60 is also illustrated, comprising a pre-sized ring that is secured to the pocket panel 50 through a loop 62.

Figure 7:
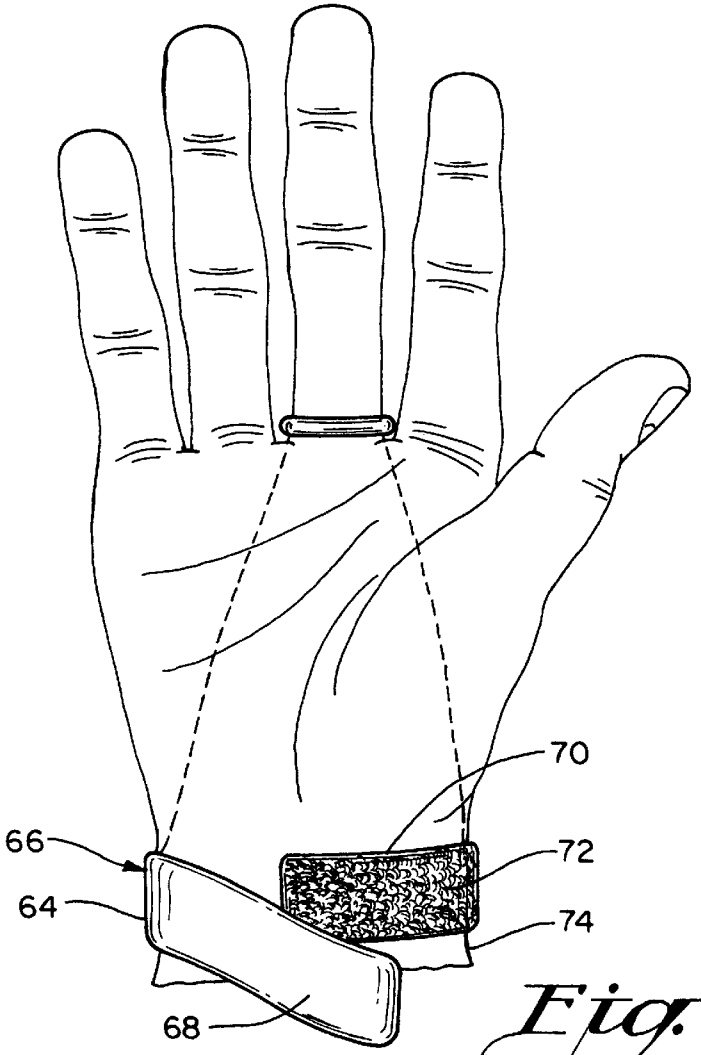
FIG. 7 is a bottom plan view of yet another version of my hand mounted pocket illustrating an adjustable wrist band.

FIG. 7 illustrates another type of a wrist band 64 that can be used with my hand mounted pocket 66. The wrist band 64 can be comprised of a strap having two ends 68, 70, wherein each of the ends has hook and loop fasteners 72 attached thereto for securing the wrist band to a wrist 74 of a user.

Figure 8:
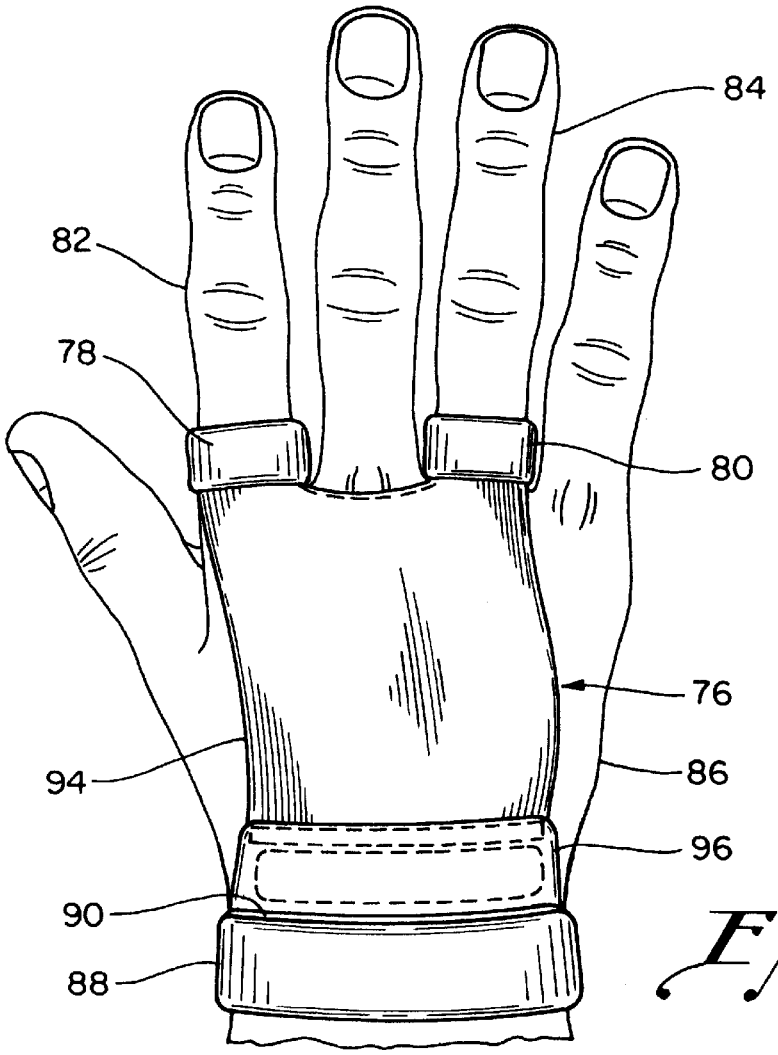
FIG. 8 is a top plan view of yet another embodiment of my invention as shown on a hand.
Figure 9:
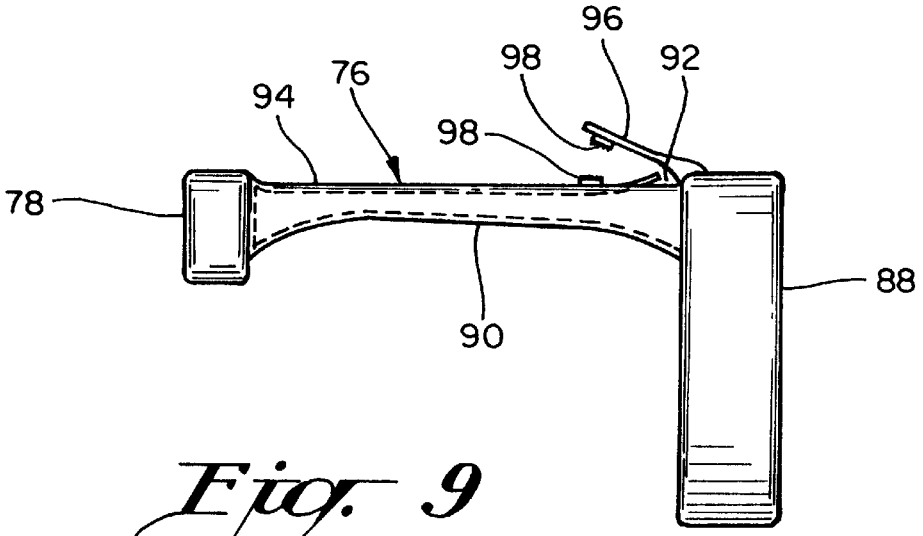
FIG. 9 is a side view of my hand mounted pocket shown in FIG. 8 illustrating important features of my invention.

FIGS. 8 and 9 illustrate yet another type of my hand mounted pocket 76 having two finger bands 78, 80 engaged with the second and fourth fingers 82, 84 of a person's hand 86. The hand mounted pocket 76 still has a wrist band 88 and a pocket 90. The pocket 90 in this embodiment is designed to have an access opening 92 extending along the width of the lower portion of the pocket panel 94. The pocket 90 can be closed by a small flap 96 having a fastener 98, such as a hook and loop fastener.

Figure 10:
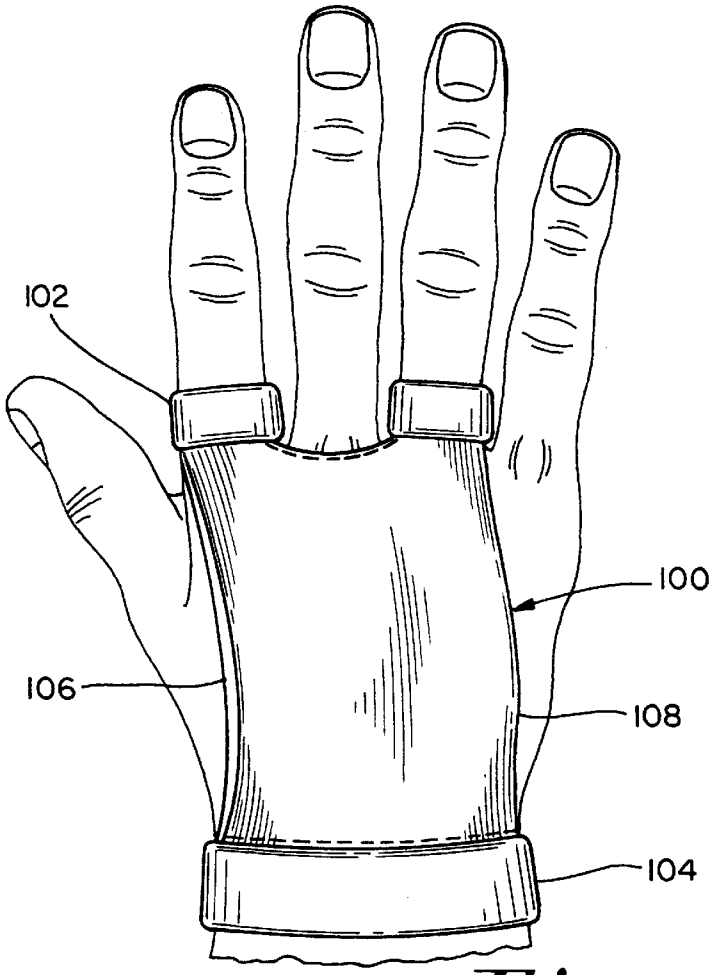
FIG. 10 is a top plan view of still another embodiment of my invention as shown on a hand.

The hand mounted pocket shown in FIGS. 8 and 9 can also be adapted to have a pocket extending along the side, as shown in FIG. 10. The hand mounted pocket 100 is designed having two finger bands 102 and a wrist band 104, wherein the pocket opening 106 is positioned on the thumb side of the pocket panel 108.

Figure 11:
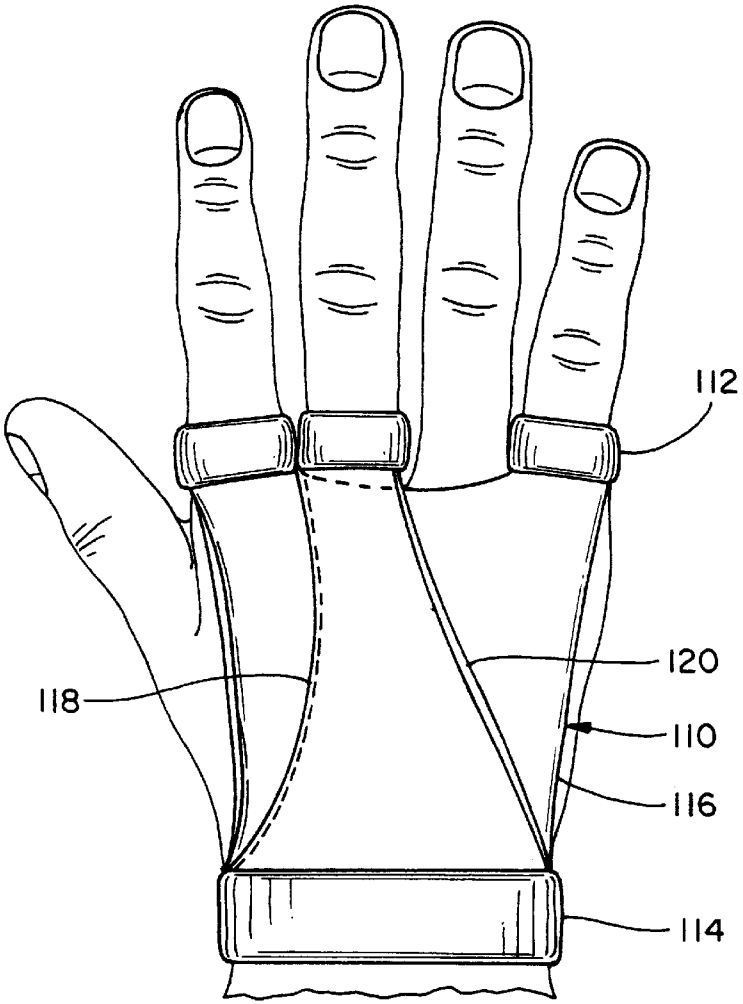
FIG. 11 is a top plan view of another embodiment of my hand mounted pocket as shown on a hand.

FIG. 11 illustrates a further design of my hand mounted pocket 110 having three finger bands 112, a wristband 114, and a pocket panel 116. This particular hand mounted pocket 110 is designed to have two pockets and two pocket openings 118, 120. This design allows a user to have additional storage space, as well as a fashionably designed hand mounted pocket.

Figure 12:
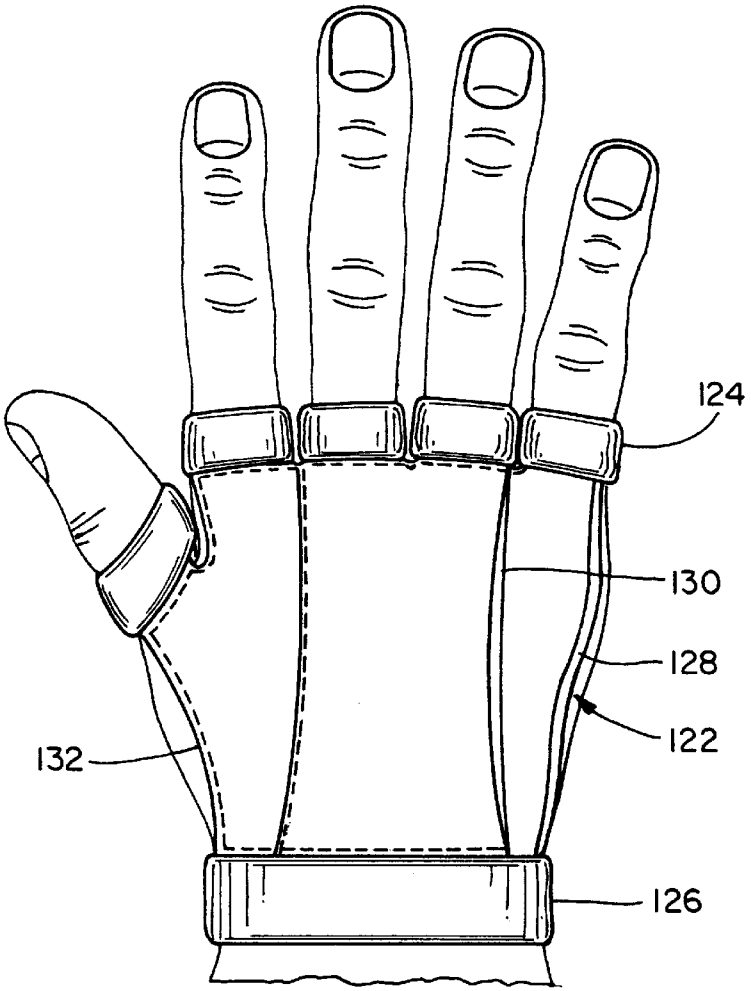
FIG. 12 is a top plan view of still yet another embodiment of my invention as shown on a hand.

The hand mounted pocket of the present invention can be designed in numerous different ways and to engage varying fingers. FIG. 12 illustrates a further design of my hand mounted pocket 122 showing five finger bands 124, a wrist band 126, and two pockets 128, 130 positioned on the pocket panel 132.

The pocket panel can be designed in various different shapes and sizes, however, one side of the pocket panel is always attached to a wrist band, and it can be designed to be used in one, two, three, four, and five finger designs. The number and choice of fingers used will allow for pockets of varying sizes. The pocket panel design or look is only limited to its attachments and its ability to perform the function of storing items. Several variations could also include additional pockets, or a loop to secure keys.

An additional benefit to the disclosed designs of the present invention is that a hand, when slightly or completely closed into a fist, a common position, will naturally tighten any slack on the pocket panel. This also helps keep objects within the pocket properly in place and also allows for a simpler type of mechanism to be used to close the pocket.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A hand mounted pocket for placement on a back of a hand, said hand mounted pocket comprising: a wrist band, said wrist band being annular and sized to engage a person's wrist, at least one finger band, said at least one finger band being annular and sized to engage at least one finger of a person's hand, and a pocket panel, said wrist band and said at least one finger band being joined by said pocket panel, wherein an upper portion of said pocket panel is attached to said at least one finger band, and a lower portion of said pocket panel is attached to said wrist band, said pocket panel being sized to extend across a back portion of a hand, said pocket panel having at least one pocket therein, said lower portion of said pocket panel having a width equivalent to a width of a person's wrist, and said upper portion of said pocket panel having a width equivalent to a width of said at least one finger band.

2. The hand mounted pocket of claim 1, wherein said pocket panel is made from a material selected from the group consisting of: spandex, rubber, cotton, leather and nylon.

3. The hand mounted pocket of claim 1, wherein said at least one pocket has an access opening extending along the length of the pocket panel on one side.

4. The hand mounted pocket of claim 1, wherein said at least one pocket has an access opening extending along the width of the lower portion of said pocket panel.

5. The hand mounted pocket of claim 1, wherein said at least one pocket comprises a flap that is hinged along the lower portion of said pocket panel, said flap being securable at edges along the upper portion and along opposite edges extending between said wrist band and said at least one finger band.

6. The hand mounted pocket of claim 1, wherein said wrist band is comprised of an elastic band.

7. The hand mounted pocket of claim 1, wherein said wrist band is comprised of a strap having two ends, each of said ends having hook and loop fasteners attached thereto for securing the wrist band to a wrist of a user.

8. The hand mounted pocket of claim 1, wherein said at least one pocket has an access opening and a hook and loop fastener closure thereon.

9. The hand mounted pocket of claim 1, wherein said at least one pocket has an access opening and a zipper closure thereon.

10. The hand mounted pocket of claim 1, wherein said at least one pocket has an access opening and a closure means comprising overlapping flaps of material.

11. The hand mounted pocket of claim 1, wherein said at least one pocket has an access opening and a zipper closure thereon.

12. A hand mounted pocket for placement on a back of a hand, said hand mounted pocket comprising: a wrist band, said wrist band being sized to engage a person's wrist, at least one finger band, said at least one finger band being sized to engage at least one finger of a person's hand, and a flexible pocket panel, said wrist band and said at least one finger band being joined by said flexible pocket panel, wherein an upper portion of said flexible pocket panel is attached to said at least one finger band, and a lower portion of said flexible pocket panel is attached to said wrist band, said flexible pocket panel being sized to extend across a back portion of a hand, said flexible pocket panel having at least one pocket therein, said lower portion of said flexible pocket panel having a width equivalent to a width of a person's wrist, and said upper portion of said flexible pocket panel having a width equivalent to a width of said at least one finger band.

13. The hand mounted pocket of claim 12, wherein said flexible pocket panel is made from a material selected from the group consisting of: spandex, rubber, cotton, leather and nylon.

14. The hand mounted pocket of claim 12, wherein said at least one pocket has an access opening extending along the length of the flexible pocket panel on one side.

15. The hand mounted pocket of claim 12, wherein said at least one pocket has an access opening extending along the width of the lower portion of said flexible pocket panel.

16. The hand mounted pocket of claim 12, wherein said at least one pocket comprises a flap that is hinged along the lower portion of said flexible pocket panel, said flap being securable at edges along the upper portion and along opposite edges extending between said wrist band and said at least one finger band.

17. The hand mounted pocket of claim 12, wherein said wrist band is comprised of an elastic band.

18. The hand mounted pocket of claim 12, wherein said wrist band is comprised of a strap having two ends, each of said ends having hook and loop fasteners attached thereto for securing the wrist band to a wrist of a user.

19. The hand mounted pocket of claim 12, wherein said at least one pocket has an access opening and a hook and loop fastener closure thereon.

* * * * *